US007309246B1

(12) United States Patent
Walter et al.

(10) Patent No.: US 7,309,246 B1
(45) Date of Patent: Dec. 18, 2007

(54) ELECTRICAL CONNECTOR WITH ESD PROTECTION

(75) Inventors: Richard Paul Walter, Elizabethtown, PA (US); Brent David Yohn, Newport, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/601,882

(22) Filed: Nov. 20, 2006

(51) Int. Cl.
*H01R 13/53* (2006.01)

(52) U.S. Cl. ..... 439/181

(58) Field of Classification Search ..... 439/181, 439/608, 607
See application file for complete search history.

(56) References Cited

U.S. PATENT DOCUMENTS 5,278,535 A * 1/1994 Xu et al. ..... 338/20
5,583,733 A * 12/1996 Cronin ..... 361/111
5,897,388 A * 4/1999 Minich ..... 439/181
6,213,811 B1 * 4/2001 Furusawa ..... 439/607
6,447,316 B1 * 9/2002 Jon et al. ..... 439/181
6,544,047 B2 * 4/2003 Moore ..... 439/95
6,561,820 B2 * 5/2003 Stone et al. ..... 439/70

* cited by examiner

*Primary Examiner*—Phuong Dinh

(57) ABSTRACT

An electrical connector assembly includes a conductive shell and a connector having a dielectric housing disposed within the shell. The housing has a mating face configured to receiver the contacts of a mating connector and a mounting face configured to mount the connector to a circuit board. A dielectric member is disposed proximate the mating face of the connector and is connected to the shell. The dielectric member includes apertures configured to receive the contacts of the mating connector therethrough when the mating connector is mated with the connector. The dielectric member includes a conductive trace that is electrically connected to the shell.

19 Claims, 5 Drawing Sheets

ELECTRICAL CONNECTOR WITH ESD PROTECTION

BACKGROUND OF THE INVENTION

The invention relates generally to electrical connectors, and more particularly, to a connector having enhanced electrostatic discharge (ESD) protection.

When connectors are being mated, opposite charges at the connector interface may result in an electrostatic discharge (ESD) between the two connectors. In fact, electrostatic discharges can be generated simply by a person approaching or touching the connector interface or touching the terminal contacts. Generally, very little current is associated with an electrostatic discharge; however, the voltage can be high enough to damage or destroy certain types of electrical devices such as semiconductor devices. Consequently, when the connector contacts or terminals are electrically associated with such devices on a circuit board, the electrostatic discharge may damage or destroy the electrical devices on the circuit board.

In order to alleviate the electrostatic discharge problem, some electrical connectors include features to provide ESD protection. In at least some connectors, ESD protection is provided with a shield in the form of a plate, bar, or the like located proximate the connector interface and connected to ground on or proximate the connector. Typically, provision is made in the connector housing for mounting the ESD shield and an ESD pathway is provided to ground the shield. However, the provision of such ESD shields may not provide adequate assurance against damage from ESD in certain applications such as line replaceable units or line replaceable connector systems that may be used in aerospace and defense systems. Additionally, providing such ESD shields may be difficult or impossible due to size or other constraints.

A need remains for a connector that provides more robust ESD protection in a cost effective manner.

BRIEF DESCRIPTION OF THE INVENTION

In one aspect, an electrical connector assembly is provided. The electrical connector assembly includes a conductive shell and a connector having a dielectric housing disposed within the shell. The housing has a mating face configured to receive the contacts of a mating connector and a mounting face configured to mount the connector to a circuit board. A dielectric member is disposed proximate the mating face of the connector and is connected to the shell. The dielectric member includes apertures configured to receive the contacts of the mating connector therethrough when the mating connector is mated with the connector. The dielectric member includes a conductive trace that is electrically connected to the shell.

More specifically, the shell is electrically connected to a ground plane in the circuit board. The dielectric member includes a front surface and a rear surface and the conductive trace includes a conductive trace on the front surface and a conductive trace on the rear surface. The front surface trace and the rear surface trace are connected to one another via plated through holes in the dielectric member. The conductive trace on the rear surface electrically engages the shell. The apertures in the conductive member include a perimeter immediately surrounded by a space void of conductive material.

In another aspect, an electrical connector assembly is provided that includes a conductive shell having a front face defining a recess formed therein. A connector has a dielectric housing disposed within the shell. The housing has a mating face configured to receive the contacts of a mating connector and a mounting face configured to mount the connector to a circuit board. A dielectric member is disposed within the recess. The dielectric member includes apertures configured to receive the contacts of the mating connector therethrough when the mating connector is mated with the connector. The dielectric member includes a conductive trace that is electrically connected to the shell.

DETAILED DESCRIPTION OF THE INVENTION

Figure 1:
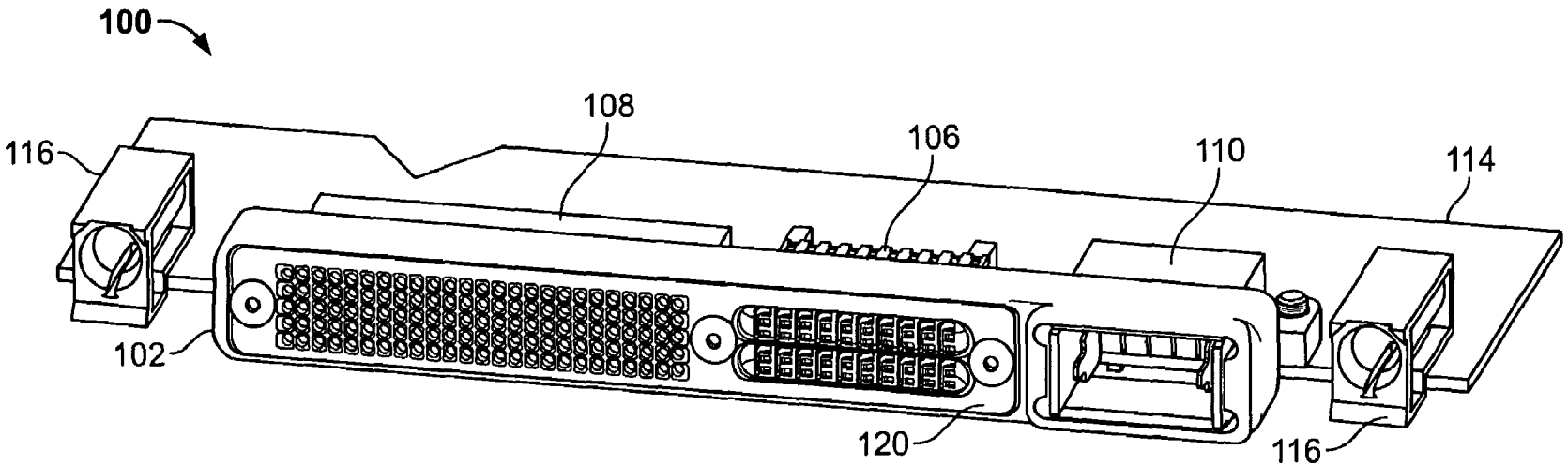
FIG. 1 is a perspective view of a connector assembly formed in accordance with an exemplary embodiment of the present invention.

FIG. 1 illustrates a perspective view of a connector assembly 100 formed in accordance with an exemplary embodiment of the present invention. The assembly 100 includes a shell 102 within which one or more connectors, such as the connectors 106, 108, and 110, are disposed. In the illustrated embodiment of the assembly 100, the connector 106 may be a high speed signal connector, the connector 108 may be an open pin field module, and the connector 110 may be a power connector. While the invention will be described in terms of the connector assembly 100 as shown, it is to be understood that the following description is for illustrative purposes only and is but one potential application of the inventive concepts herein. It is appreciated that the benefits and advantages of the invention may accrue equally to other types of connector assemblies including other connector combinations.

As illustrated in FIG. 1, the connectors 106, 108, and 110, are mounted at the edge of a circuit board 114. In alternative embodiments, the connectors 106, 108, and 110 may be vertically mounted on the circuit board 114. Guide pin receptacles 116 are provided to align a mating connector assembly (not shown) for mating with the assembly 100. In the illustrated embodiment, the guide pin receptacles 116 as well as the shell 102 are also configured to be mounted at the edge of the circuit board 114. A grille 120 is attached to the shell 102 such that the grille is interposed between the connectors 106 and 108 and mating connectors (not shown) as will be described.

Figure 2:
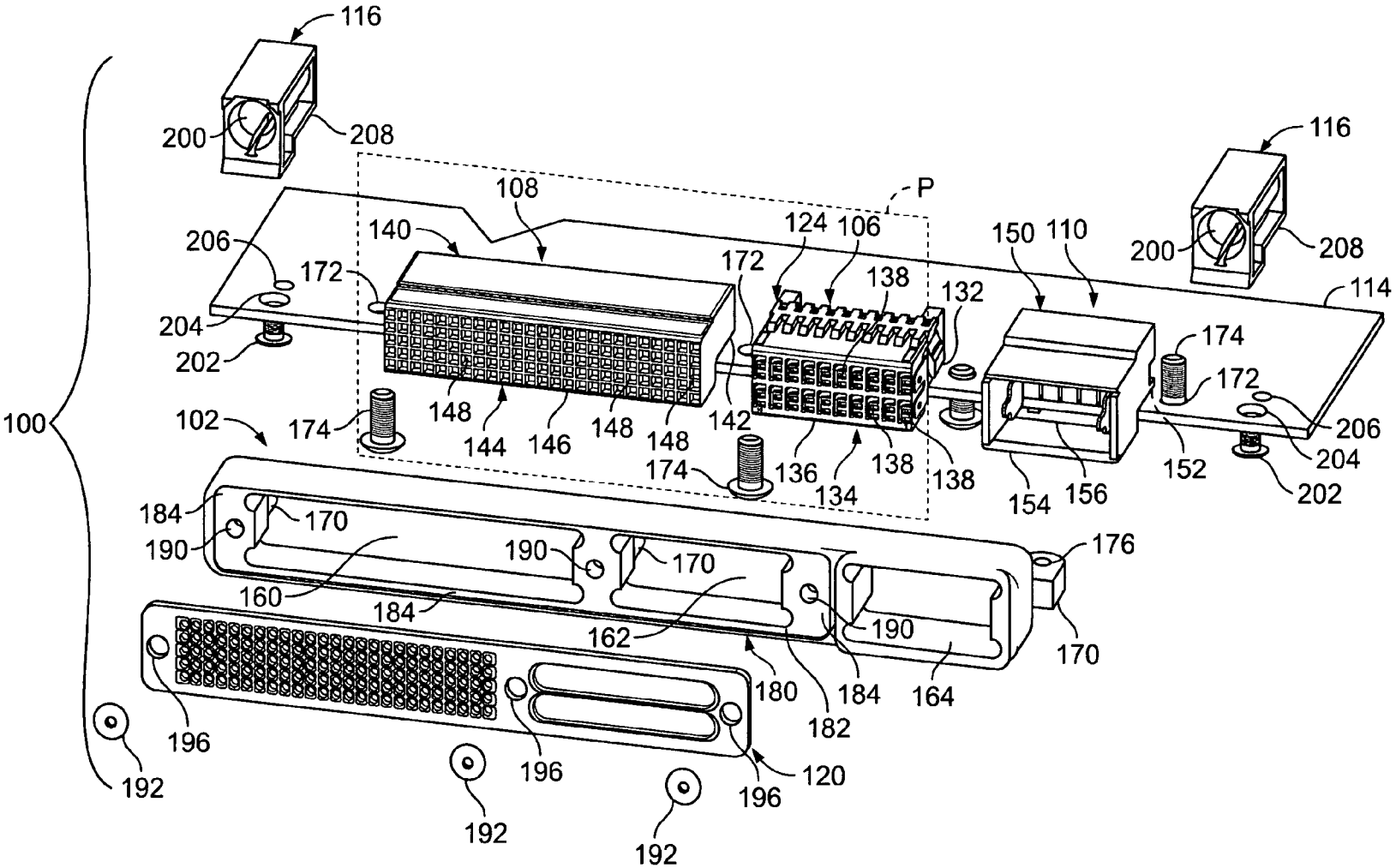
FIG. 2 is an exploded view of the assembly shown in FIG. 1.
Figure 3:
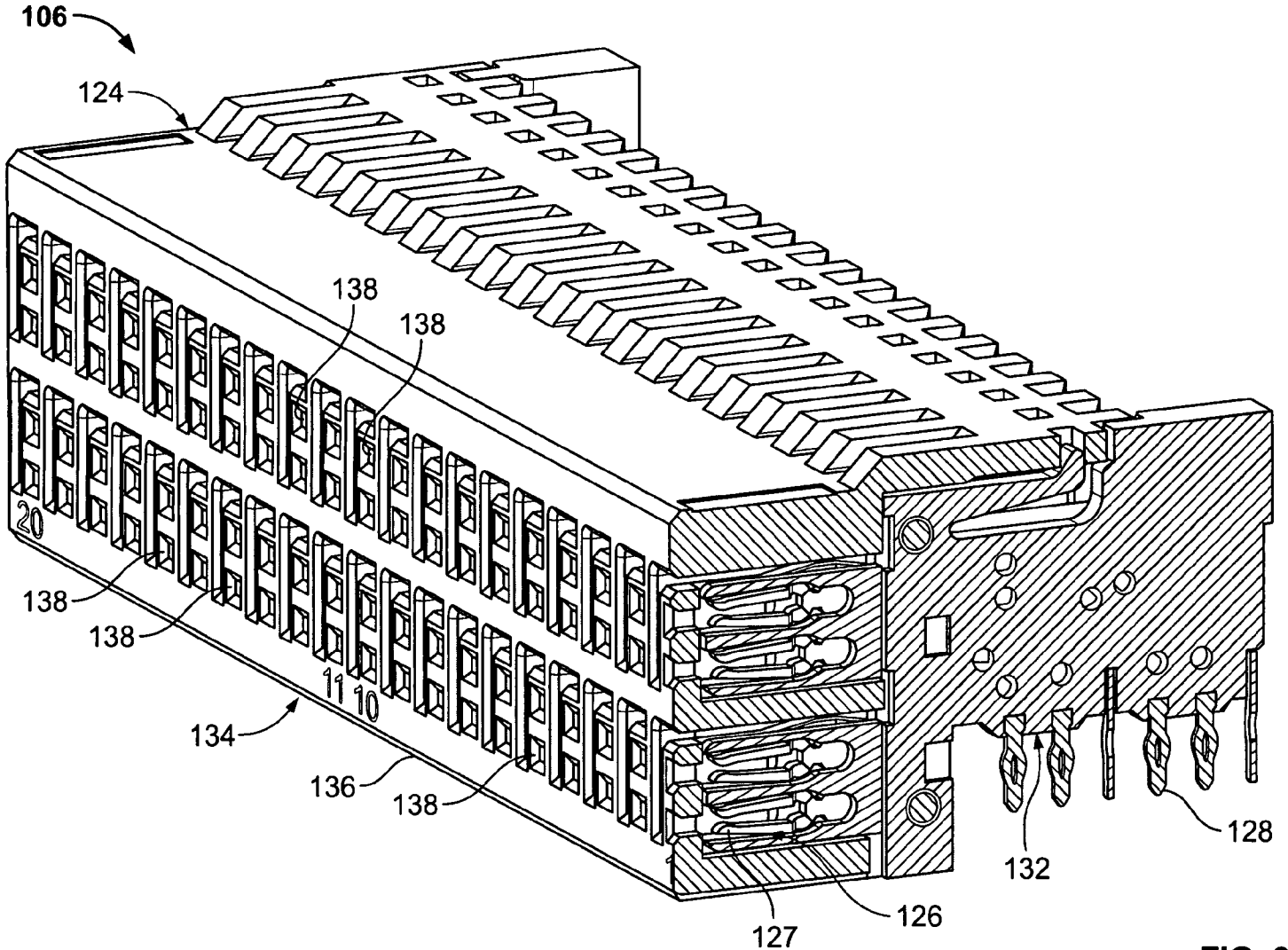
FIG. 3 is an enlarged view of the signal connector shown in FIG. 1.

FIG. 2 illustrates an exploded view of the connector assembly 100. FIG. 3 illustrates an enlarged perspective view of the connector 106. The connector 106 includes a housing 124 fabricated from a dielectric material. For illustration purposes, an end of the housing 124 is removed to reveal some of a plurality of contacts 126 held in the housing 124. The contacts 126 include mating ends 127 and mounting ends 128 formed at an angle to one another which in the illustrated embodiment may be a right angle. The housing 124 has a mounting face 132 through which the contact mounting ends 128 extend to mount the connector 106 on the circuit board 114. The housing 124 has a mating end 134 having a mating face 136 that defines a plurality of contact apertures 138. The contact apertures 138 are configured to receive mating contacts of a mating connector (not shown) that electrically connect with the mating ends 127 of the contacts 126 contacts within the contact apertures 138.

Similar to the connector 106, the connector 108 also includes a dielectric housing 140 fabricated from a dielectric material and holding a plurality of electrical contacts (not shown). The housing 140 has a mounting face 142 through which the contacts within the housing connect to electrical circuitry in/on the circuit board 114 and mount the connector 108 to the circuit board 114. The housing 140 has a mating end 144 having a mating face 146 that defines a plurality of contact apertures 148. The contact apertures 148 are configured to receive mating ends of contacts from a mating connector (not shown). The mating faces 136 and 146 of the connectors 106 and 108 respectively, lie substantially in the same plane P.

The connector 110 includes a housing 150 fabricated from a dielectric material and holding a plurality of electrical contacts (not shown). The housing 150 has a mounting face 152 through which the contacts within the housing connect to electrical circuitry in/on the circuit board 114. The housing 150 has a mating end 154 that defines an opening 156 that receives the mating end of a mating connector (not shown).

The shell 102 is fabricated from a conductive material and includes openings 160, 162, and 164 that receive the mating ends 144, 134, and 154, respectively of the connector housings 140, 124, and 150, respectively. The shell 102 includes mounting lugs 170, only one of which is completely visible in FIG. 2, for attachment of the shell 102 to the circuit board 114. In an exemplary embodiment, the circuit board 114 includes plated through holes 172 that receive fasteners 174 to mount the shell 102 to the circuit board 114. The fasteners 174 are also received in attachment holes 176 in the mounting lugs 170 of the shell 102. In an exemplary embodiment, the fasteners 174 are fabricated from a metallic or conductive material and the fasteners 174 and the attachment holes 176 may be threaded to mount of the shell 102 to the circuit board 114. When mounted on the circuit board, the shell 102 is electrically connected to a ground plane in the circuit board 114 via the plated holes 172 and fasteners 174. Alternatively, the shell 102 may directly contact a ground plane trace on the surface of the circuit board 114.

The shell 102 has a front face 180 that defines a recess 182 sized to receive the grille 120. The recess 182 and the grille 120 extend over the openings 160 and 164. The recess defines a ledge 184 upon which the grille 120 rests when installed on the shell 102. The shell 102 includes threaded attachment holes 190. Threaded fasteners 192 are received in through holes 196 and thereafter into the attachment holes 190 to attach the grille 120 to the shell 102.

Each guide pin receptacle 116 includes an opening 200 sized to receive a guide pin (not shown) of a mating connector assembly (not shown). In the illustrated embodiment, the guide pin receptacles 116 are mounted to the circuit board 114 using threaded fasteners 202 that extend through mounting holes 204 and are received in threaded holes (not shown) in the guide pin receptacles 116. Alignment holes 206 are provided in the circuit board 114 that are configured to receive an alignment peg (not shown) on an underside 208 of each guide pin receptacle 116 to align and position the guide pin receptacle 116 with respect to the circuit board 114 and the connectors 106, 108, and 110. In alternative embodiments, the guide pin receptacles 116 may be attached to or formed integrally with the shell 102.

Figure 4:
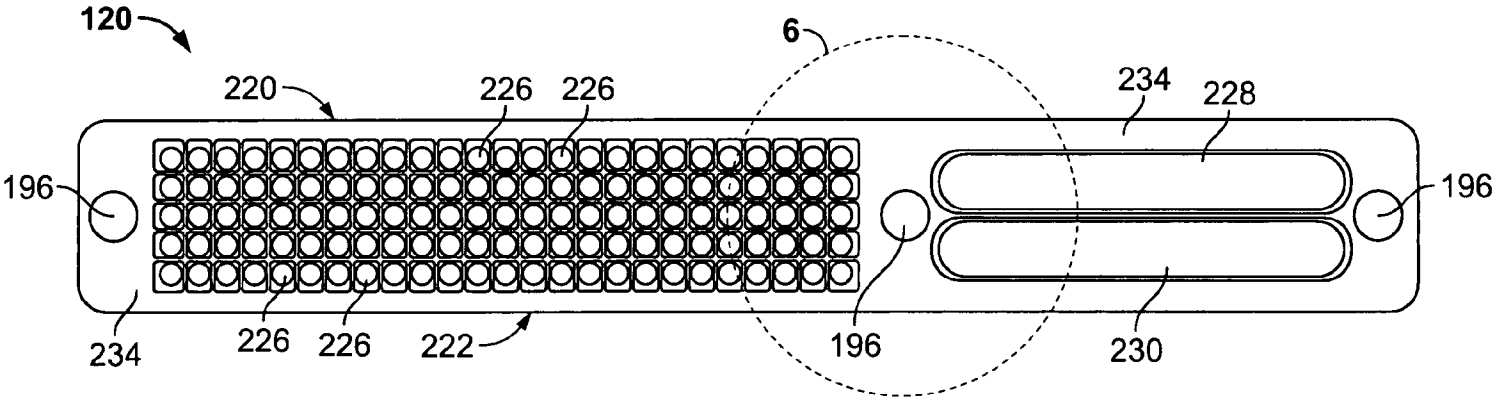
FIG. 4 is a front view of the grille shown in FIG. 2.
Figure 5:
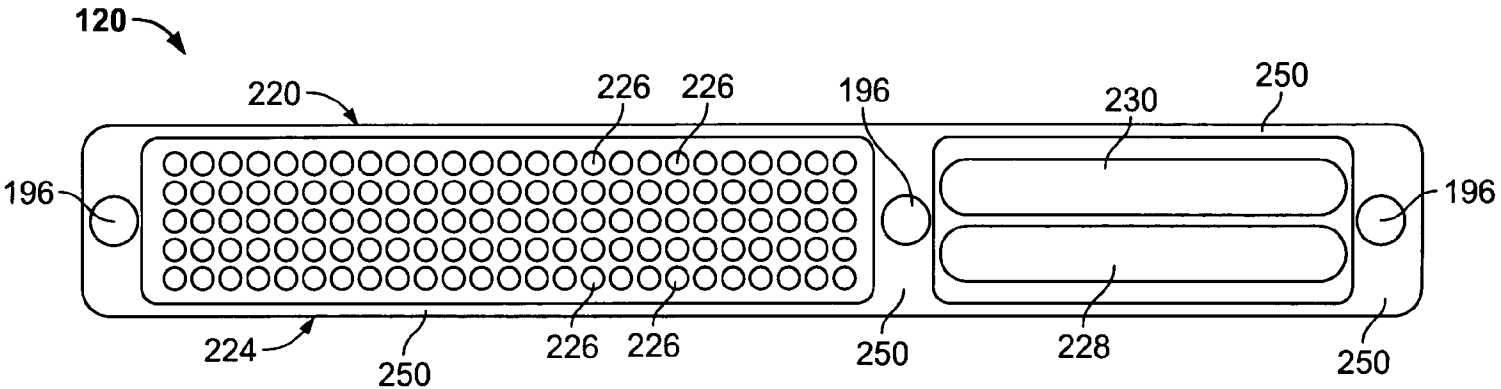
FIG. 5 is a rear view of the grille shown in FIG. 2.
Figure 6:
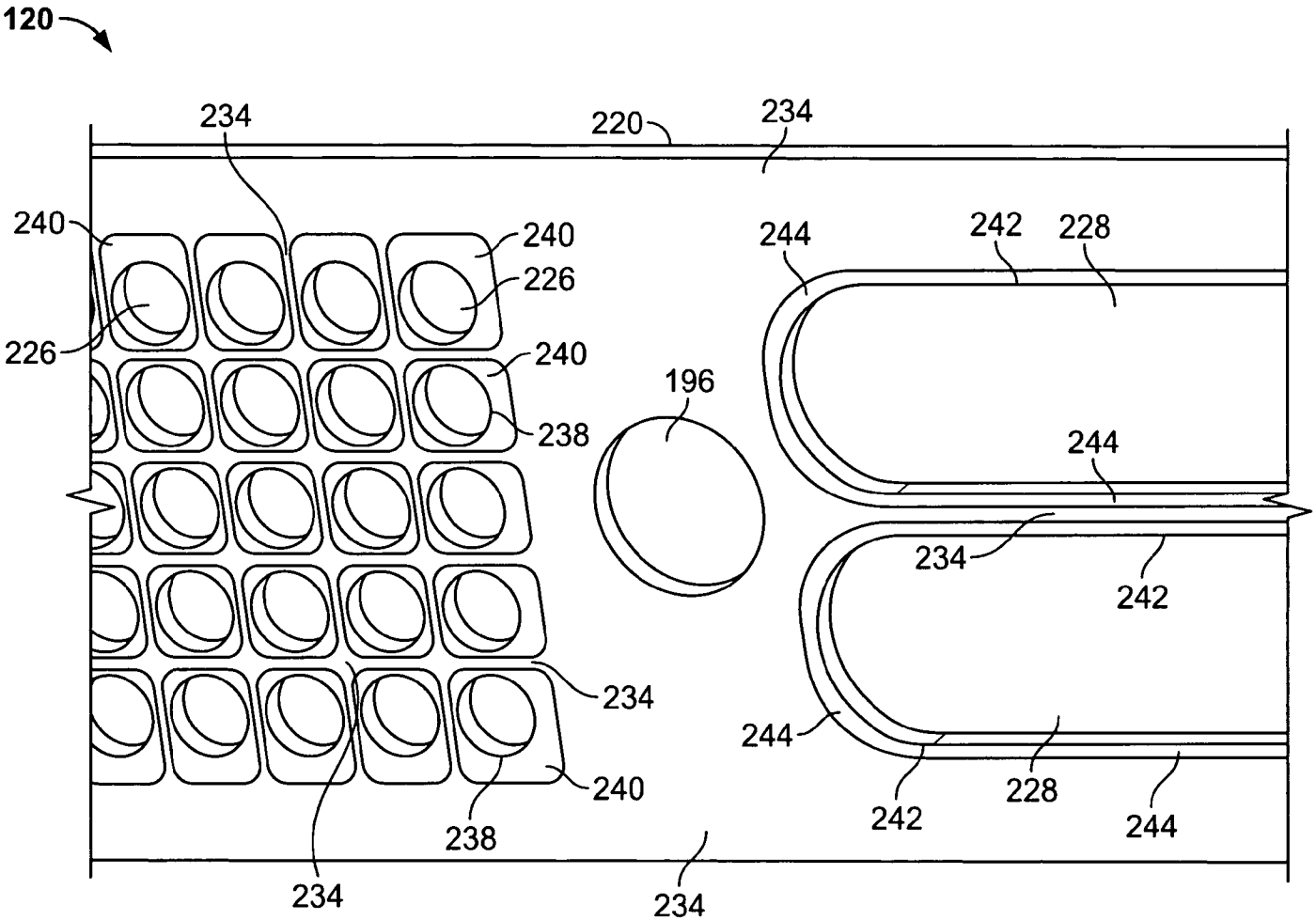
FIG. 6 is an enlarged fragmentary view of the front of the grille shown in FIG. 4.

FIG. 4 illustrates a front view of the grille 120. FIG. 5 illustrates a rear view of the grille 120. FIG. 6 is an enlarge fragmentary view of the front of the grille 120. The grille 120 includes a substantially planar dielectric member 220 having a front surface 222 and a rear surface 224. By way of example only, the dielectric member 220 may be fabricated from any material commonly used to fabricate circuit boards. The dielectric member 220 includes openings through which the contacts of a mating connector (not shown) must pass when being mated to the connector assembly 100 (FIG. 1). With respect to the connector 108, apertures 226 are provided for each contact aperture 148 (FIG. 2). With respect to the connector 106, elongated apertures 228 are provided that surround the upper contact rows and the lower contact rows of the connector 106.

The dielectric member 220, as illustrated, is substantially rectangular in shape, however, more generally, the dielectric member 220 is complementary to the shape of the recess 182 formed in the shell 102 (FIG. 2). When installed in the shell 102 the dielectric member 220 lies along a plane that is substantially parallel to the plane P of the mating faces 136 and 146 of the connectors 106 and 108 (FIG. 2). In an exemplary embodiment, the dielectric member 220 is sufficiently thin so that mating of the connector assembly 100 with a mating assembly (not shown) is not interfered with. As such, the dielectric member 220, in some embodiments, may be recessed slightly within the shell 102. However, n other embodiments, the front surface 222 of the dielectric member 220 may not be recessed within the shell 102 depending on the configuration of the mating surfaces of the mating connector assembly. The dielectric member 220 covers the openings 160 and 162 in the shell 102 as well as the mating faces 136 and 146 of the connectors 106 and 108 respectively. Further, the rear surface 224 of the dielectric member 220 lies in close proximity to the mating faces 136 and 146 of the connectors 106 and 108 and may or may not contact the mating faces 136 and 146 depending on the tolerances in the positioning of the shell 102 and the connectors 106 and 108 on the circuit board 114 (FIG. 2).

The front surface 222 of the dielectric member 220 includes a conductive trace 234 that extends around an outer perimeter of the dielectric member 220 and around the through holes 196. As shown most clearly in FIG. 6, the conductive trace 234 also extends around the apertures 226 and the elongated apertures 228. In contrast to the through holes 196, a perimeter 238 of each aperture 226 is surrounded by an unplated space 240 into which the conductive trace 234 does not extend. More specifically, each aperture 226 and the space 240 immediately surrounding each aperture are void of conductive material. Similarly, each of the elongated apertures 228 has a perimeter 242 that is immediately surrounded by an unplated space 240 into which the conductive trace 234 does not extend.

The rear surface 224 of the dielectric member 220 includes a conductive trace 250 that extends around an outer perimeter of the dielectric member 220 and around the through holes 196. The through holes 196 are plated so that the conductive trace 234 on the front surface 222 is electrically connected to the conductive trace 250 on the rear surface 224. Thus, when the grille 120 is attached to the shell 102 and the shell is mounted on the circuit board 114 (FIG. 1), a conductive path to ground is established from the conductive trace 234 on the front surface 222 of the dielectric member 220 of the grille 120. During the process of mating the connector assembly 100 (FIG. 1) with a mating connector assembly (not shown), the grille 120 is the first component of the connector assembly 100 to be brought into close proximity with the mating connector. The conductive trace 234 on the front surface 222 of the grille 120 is designed to capture an electrostatic discharge (ESD) and conduct the ESD safely to ground via the conductive path to ground from the conductive trace 234 on the grille 120 to the shell 102 and to the ground plane on the circuit board 114. In this manner, the risk of arching reaching the contacts of the connectors 106 and 108 is minimized. Moreover, the ground path from the conductive trace 234 on the grille 120 facilitates the prevention of damage to the connectors 106 and 108 as well as other electrical components (not shown) on the circuit board 114 (FIG. 1) from an ESD near the connectors 106 and 108.

The embodiments herein described provide a connector assembly with enhanced electrostatic discharge (ESD) protection at a reasonable cost. The connectors are disposed within a shell having a grille attached to a front surface thereof. The grille is comprised of a dielectric member having interconnected conductive traces on front and rear surfaces. The shell is electrically connected to a ground plane to provide a path to ground from the conductive traces on the front of the grille. The traces on the front surface surrounds contact apertures in the grille to capture an electrostatic discharge. With the ESD protection provided, the connector assembly is suitable for use in line replaceable units or line replaceable connector systems.

While the invention has been described in terms of various specific embodiments, those skilled in the art will recognize that the invention can be practiced with modification within the spirit and scope of the claims.

What is claimed is:

1. An electrical connector assembly comprising:

a conductive shell;

a connector having a dielectric housing disposed within said shell, said housing having a mating face configured to receive contacts of a mating connector and a mounting face configured to mount said connector to a circuit board; and a dielectric member disposed proximate said mating face of said connector and connected to said shell, said dielectric member including apertures configured to receive the contacts of the mating connector therethrough when the mating connector is mated with said connector, said dielectric member having a front surface including a conductive trace thereon that is electrically connected to said shell.

2. The electrical connector assembly of claim 1, wherein said shell is electrically connected to a ground plane in the circuit board.

3. The electrical connector assembly of claim 1, wherein said dielectric member further includes a rear surface having a conductive trace thereon, and wherein said front surface trace and rear surface trace are connected to one another via plated through holes in said dielectric member.

4. An electrical connector assembly comprising:

a conductive shell;

a connector having a dielectric housing disposed within said shell, said housing having a mating face configured to receive contacts of a mating connector and a mounting face configured to mount said connector to a circuit board; and a dielectric member disposed proximate said mating face of said connector and connected to said shell, said dielectric member including apertures configured to receive the contacts of the mating connector therethrough when the mating connector is mated with said connector, said dielectric member including a conductive trace that is electrically connected to said shell and, wherein said dielectric member includes a front surface and a rear surface and said conductive trace includes a conductive trace on said front surface and a conductive trace on said rear surface, and wherein said rear surface trace electrically engages said shell.

5. The electrical connector assembly of claim 1, wherein said apertures in said dielectric member include a perimeter immediately surrounded by a space void of conductive material.

6. The electrical connector assembly of claim 1, wherein said conductive trace on said dielectric member cooperates with said shell to provide a ground path for an electrostatic discharge proximate said apertures in said dielectric member.

7. The electrical connector assembly of claim 1 further comprising a guide pin receptacle configured to receive a guide pin on the mating connector.

8. The electrical connector assembly of claim 1 further comprising a guide pin receptacle configured to receive a guide pin on the mating connector, and wherein said guide pin is attached to one of the circuit board and the shell.

9. The electrical connector assembly of claim 1, wherein said connector is configured to be mounted on an edge of the circuit board.

10. The electrical connector assembly of claim 1, wherein said connector is configured to be vertically mounted on the circuit board.

11. An electrical connector assembly comprising:

a conductive shell having a front face defining a recess formed therein;

a connector having a dielectric housing disposed within said shell, said housing having a mating face configured to receive contacts of a mating connector and a mounting face configured to mount said connector to a circuit board; and a dielectric member disposed within said recess, said dielectric member including apertures configured to receive the contacts of the mating connector therethrough when the mating connector is mated with said connector, said dielectric member having a front surface including a conductive trace thereon that is electrically connected to said shell.

12. The electrical connector assembly of claim 11, wherein said dielectric member is positioned proximate said mating face of said connector.

13. The electrical connector assembly of claim 11, wherein said shell is electrically connected to a ground plane in the circuit board.

14. The electrical connector assembly of claim 11, wherein said dielectric member further includes a rear surface having a conductive trace thereon, and wherein said front surface trace and rear surface trace are connected to one another via plated through holes in said dielectric member.

15. The electrical connector assembly of claim 11, wherein said dielectric member further includes a rear surface having a conductive trace thereon, and wherein said rear surface trace electrically engages said shell.

16. The electrical connector assembly of claim 11, wherein said apertures in said dielectric member include a perimeter immediately surrounded by a space void of conductive material.

17. The electrical connector assembly of claim 11, wherein said conductive trace on said dielectric member cooperates with said shell to provide a ground path for an electrostatic discharge proximate said apertures in said dielectric member.

18. The electrical connector assembly of claim 11 further comprising a guide pin receptacle configured to receive a guide pin on the mating connector.

19. The electric connector assembly of claim 11 further comprising a guide pin receptacle configured to receive a guide pin on the mating connector, and wherein said guide pin is attached to one of the circuit board and the shell.

* * * * *